US005711685A

United States Patent [19]

Wood

[11] Patent Number: 5,711,685

[45] Date of Patent: Jan. 27, 1998

[54] ELECTRICAL CONNECTOR HAVING REMOVABLE SEAL AT CABLE ENTRY END

[75] Inventor: Richard G. Wood, Magnolia, Tex.

[73] Assignee: Tescorp Seismic Products, Inc., Houston, Tex.

[21] Appl. No.: 590,148

[22] Filed: Jan. 23, 1996

[51] Int. Cl.[6] ..... H01R 13/40

[52] U.S. Cl. ..... 439/587

[58] Field of Search ..... 439/587, 589, 439/279, 281, 282

[56] References Cited

U.S. PATENT DOCUMENTS

| | | | |
|---|---|---|---|
| H113 | 8/1986 | McNeel | 439/282 |
| 2,843,133 | 7/1958 | Barbara | 131/207 |
| 2,881,406 | 4/1959 | Arson | 439/589 |
| 3,197,730 | 7/1965 | Hargett | 339/102 |
| 3,449,182 | 6/1969 | Wiltshire | 156/69 |
| 3,461,529 | 8/1969 | Van Dorn | 29/149.5 |
| 3,497,864 | 2/1970 | Barnet | 339/60 |
| 3,641,479 | 2/1972 | O'Brien et al. | 439/277 |
| 3,693,133 | 9/1972 | Harbonn et al. | 339/48 |
| 3,739,330 | 6/1973 | Hazelhurst et al. | 340/17 |
| 3,745,511 | 7/1973 | Fussell | 339/49 |
| 3,783,434 | 1/1974 | Ransford | 439/281 |
| 3,888,559 | 6/1975 | Geib | 339/46 |
| 3,937,545 | 2/1976 | Cairns et al. | 339/60 R |
| 3,954,154 | 5/1976 | Kruppenbach et al. | 181/112 |
| 4,032,214 | 6/1977 | McNerney | 339/218 M |
| 4,090,759 | 5/1978 | Herrmann | 439/281 |
| 4,150,866 | 4/1979 | Snyder et al. | 439/275 |
| 4,284,312 | 8/1981 | Patchett et al. | 439/281 |
| 4,355,855 | 10/1982 | Rebikoff | 339/94 A |
| 4,445,741 | 5/1984 | Annoot | 339/49 |
| 4,480,151 | 10/1984 | Dozier | 174/153 R |
| 4,497,531 | 2/1985 | Baker | 339/94 M |
| 4,588,247 | 5/1986 | Grappe et al. | 339/94 M |
| 4,589,939 | 5/1986 | Mohebban et al. | 156/49 |
| 4,609,247 | 9/1986 | Annoot | 339/60 M |
| 4,632,482 | 12/1986 | Punako et al. | 339/59 M |
| 4,758,174 | 7/1988 | Michaels et al. | 439/281 |
| 4,767,349 | 8/1988 | Pottier et al. | 439/191 |
| 4,767,356 | 8/1988 | Grappe | 439/455 |
| 4,790,768 | 12/1988 | Domingues | 439/320 |
| 4,820,170 | 4/1989 | Redmond et al. | 439/66 |
| 4,861,288 | 8/1989 | Friedman | 439/736 |
| 4,921,452 | 5/1990 | Dozier | 439/622 |
| 5,014,813 | 5/1991 | Fussell | 181/122 |
| 5,120,237 | 6/1992 | Fussell | 439/282 |
| 5,120,268 | 6/1992 | Gerrans | 439/736 |
| 5,130,954 | 7/1992 | Fussell | 367/188 |
| 5,145,410 | 9/1992 | Maejima et al. | 439/587 |
| 5,183,966 | 2/1993 | Hurtado | 474/20 |
| 5,199,893 | 4/1993 | Fussell | 439/271 |
| 5,297,974 | 3/1994 | Fussell | 439/320 |
| 5,362,258 | 11/1994 | Arnswald et al. | 439/695 |
| 5,387,119 | 2/1995 | Wood | 439/281 |

FOREIGN PATENT DOCUMENTS

| | | |
|---|---|---|
| 63398 | 8/1968 | German Dem. Rep. . |
| 2131633 | 6/1984 | United Kingdom . |

*Primary Examiner*—Gary F. Paumen
*Assistant Examiner*—Christopher Goins
*Attorney, Agent, or Firm*—Jenkens & Gilchrist, P.C.

[57] ABSTRACT

An electrical connector has a body and seal member in which the body has embedded electrical conductors that extend outwardly from the cable entry end of the body. The body also includes integrally formed sheaths that surround a portion of each of the outwardly extending electrical conductors. The seal member has internal passageways that are adapted to provide a waterproof seal around each of the sheaths and around the insulation jacket of each wire lead attached to one of the electrical conductors. The electrical connector effectively and economically solves the problem of providing a field repairable waterproof seal at the cable entry end of a connector by sealing the sheath surrounding the conductor and the jacket surrounding the wire lead on each side of the electrical connection between the conductor and lead.

11 Claims, 3 Drawing Sheets

ELECTRICAL CONNECTOR HAVING REMOVABLE SEAL AT CABLE ENTRY END

BACKGROUND OF THE INVENTION

1. Technical Field

This invention relates generally to seals for electrical connectors, and more particularly to a seal for the termination of a cable at an electrical connector.

2. Background Art

Sealing of cable termination assemblies, such as at the connecting point with a connector, has been a long-standing problem. In underwater applications it has been particularly difficult to seal around the insulating jacket of each wire in a cable assembly to prevent infiltration of water into the connection of each of the wires to a conductor or contact. If electrical isolation of each connection point is not maintained, shorts can occur between wires or conductors.

Heretofore, this problem has been addressed by potting the wire-conductor connections in a moldable insulating material or by using heat-shrink tubing over the connection points. For example, U.S. Pat. No. 4,032,214 issued to Richard McNerney and assigned to Slumberger Technology Corporation describes a cable-termination assembly and method of manufacture wherein unitary fluid barriers are molded around the insulating jacket of individual wires in a cable assembly to provide a seal around the exterior of the jacket. After molding of the unitary barriers, a second molding operation forms a body that is bonded to a contact support member and to the previously molded fluid barriers. After the second molding, the termination assembly cannot be disassembled for repair of individual connections, replacement of damaged wires, or substitution of damaged wires with other unused wires within the cable assembly. Therefore, if even one of the electrical connections between a contact of the connector and a wire in the cable assembly fails, the entire cable and connector must be replaced.

A more recent method of sealing termination assemblies is described in U.S. Pat. No. 5,183,966 issued to Hurtado et al, now assigned to the assignee of the present invention. Hurtado et al forms a water block for the splice connection between two conductors by placing a pair of O-rings over the insulating jacket of the wires on each side of the connection, and then pulling a length of heat shrink tubing over both sets of the O-rings and the splice joint. The tubing is then shrunk by the application of heat. This method requires that the conductors on each side of the splice be sealed in a rigid potting material, thereby preventing the replacement of damaged wires within the cable assembly.

The present invention is directed to overcoming the problems set forth above. It is desirable to have a simple, economical sealing arrangement for providing a waterproof seal about the connection point of a wire with another wire or conductor to which the wire is joined. It is also desirable to have such a waterproof seal that effectively provides separate seals around the insulation jacket of each wire in a cable assembly and around each electrically conductive member in a connector to which the wires are electrically joined. Furthermore, it is desirable that such a seal be readily removable to provide access to the connection points between the wires and connected conductors to permit field repair or replacement of failed connections, wires or conductors.

SUMMARY OF THE INVENTION

In accordance with one aspect of the present invention, an electrical connector assembly includes a body having a cable entry end and a seal member having a first end adapted to mate with the cable entry end of the body. The body has at least one electrical conductor disposed therein having a portion extending outwardly from the cable entry end with a distal end adapted for connection with an electrical lead component of a predefined cable assembly. The body also includes at least one sheath integrally formed with the body that has a predefined outer diameter and length extending a predetermined distance along and around the outwardly extending portion of the electrical conductor to a position near the distal end of the conductor. The seal member has a second end spaced from the first end and at least one internal passageway extending through the seal member from the first to the second end. The internal passageway has a first portion extending inwardly from the first end a distance substantially equal to the length of the outwardly extending portion of the conductor, and has an internal diameter that is less than the predefined outer diameter of the sheath. The internal passageway also has a second portion that extends inwardly from the second end that is adapted to provide an interference fit around the insulation jacket of a predefined electrical lead when the lead is inserted through the second portion of the passageway.

Other features of the electrical connector assembly embodying the present invention include the sheath being formed of a substantially rigid material, the seal member being formed of a compressible material, and the first and second portions of the internal passageway through the seal member being defined by internal walls having a plurality of deformable ridges that form sealing rings around the sheath and the insulation jacket of the predefined wire lead member. Alternatively, the seal member may be formed of a substantially rigid material and the sheath extending outwardly from the connector body and the insulation jacket of predefined wire lead member formed of a relatively compressible material.

In another aspect of the present invention, a removable seal for sealing the termination of a cable assembly has a first face surface adapted to mate with the cable entry end of a predefined electrical connector, a second face surface spaced from the first face surface, and at least one internal passageway extending through the seal from the first face surface to the second face surface. The internal passageway has a first portion extending inwardly from the first face surface a distance substantially equal to the predefined length of a conductor extending outwardly from the cable entry end of the connector. The first portion of the internal passageway has an internal diameter adapted to provide an interference fit between the first portion of the internal passageway and a sheath surrounding at least a portion of the outwardly extending conductor when the removable seal is assembled on the sheath. The internal passageway also has a second portion extending inwardly from the second face surface of the seal that is adapted to provide an interference fit around a predefined wire lead member of the cable assembly when the lead member is inserted through the second portion of the passageway.

Other features of the removable seal embodying the present invention, include the removable seal being formed of a compressible material and the first and second portions of the internal passageway being defined by internal walls comprising a plurality of compressibly deformable ridges that form a plurality of sealing rings around the sheath of the predefined connector and the insulation jacket of the predefined wire lead member. Alternatively, the removable seal embodying the present invention may be formed of a substantially rigid material when the sheath of the connector and the insulation jacket of the wire lead member are formed of a relatively compressible material.

DETAILED DESCRIPTION OF THE INVENTION

Figure 1:
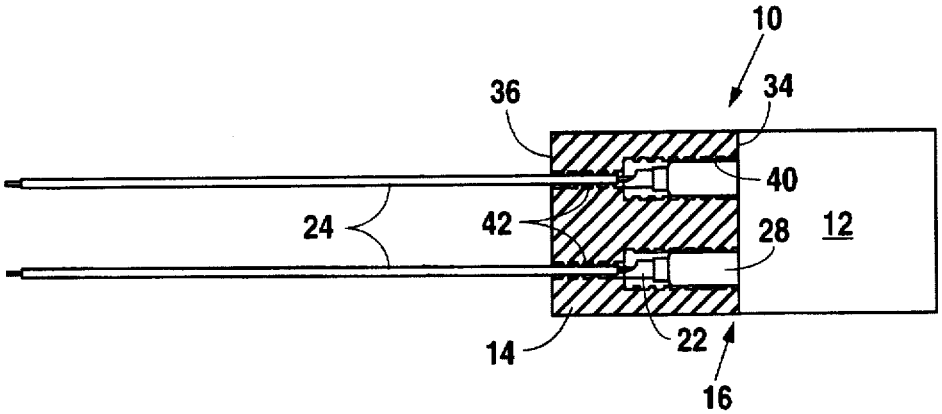
FIG. 1 is a simplified schematic representation of the electrical connector assembly embodying the present invention, showing the connector body in elevation and the seal member in cross section.
Figure 3:
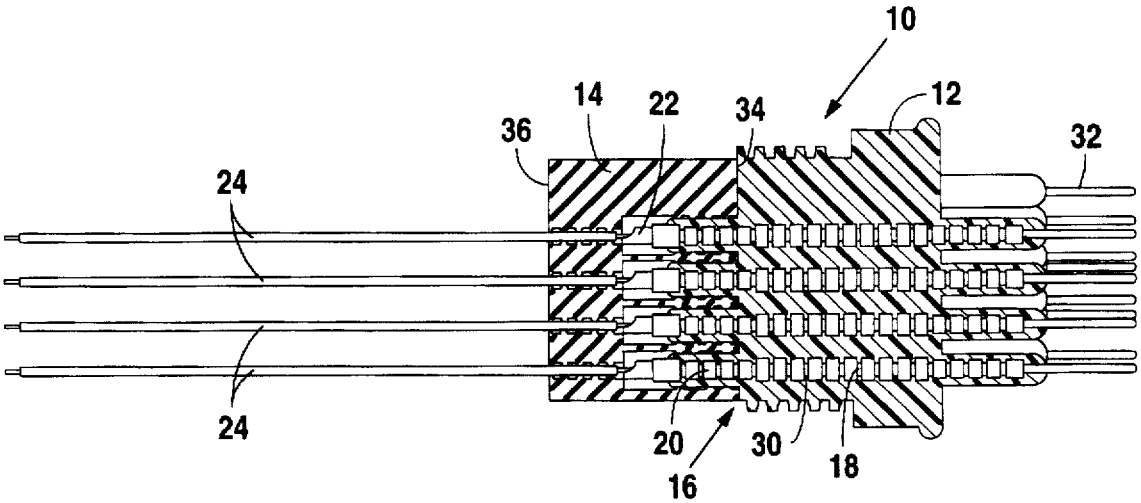
FIG. 3 is a cross-sectional view of the seal member and the body of the electrical connector embodying the present invention.
Figure 4:
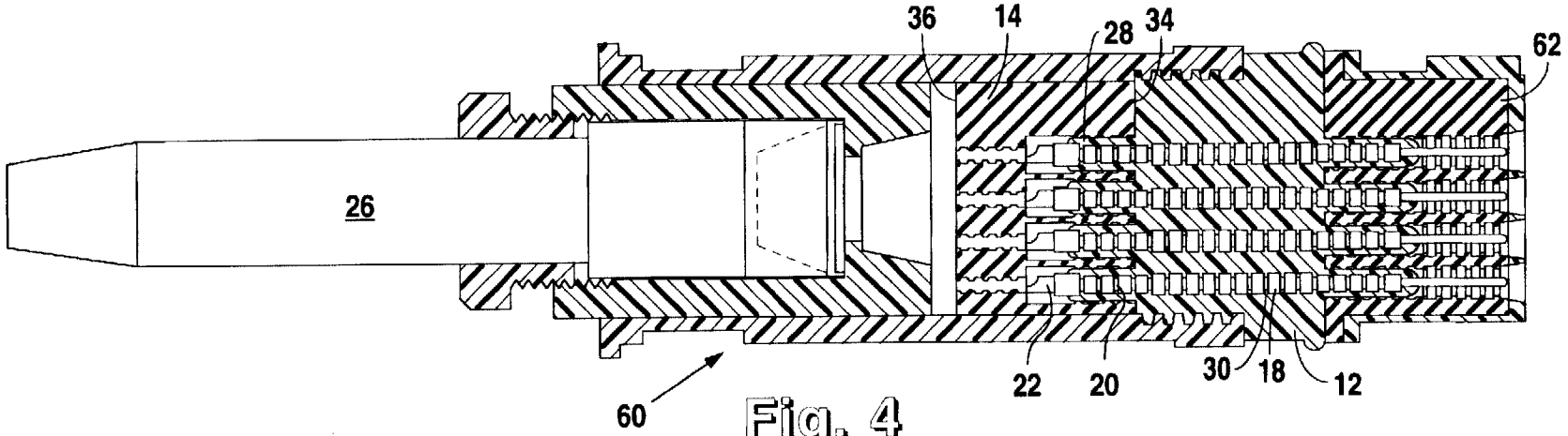
FIG. 4 is a cross-sectional view of the electrical connector embodying the present invention enclosed within a separable shell assembly.

An electrical connector embodying the present invention is generally indicated in the drawings by the reference numeral 10 which, as represented in FIG. 1 in simplified form, includes a body 12 and a seal member 14. The body 12 has a cable entry end 16 and at least one, and more typically a plurality of, electrical conductors 18 disposed within the body 12, as best shown in FIGS. 3 and 4. The electrical conductors 18 extend through the body 12 and have a portion 20 that additionally extends outwardly from the cable entry end 16 of the body 12, terminating at a distal end 22 that is adapted, for example with a conventional solder lug or crimp connector, for connection with an electrical lead 24 of a cable assembly 26.

Figure 5:
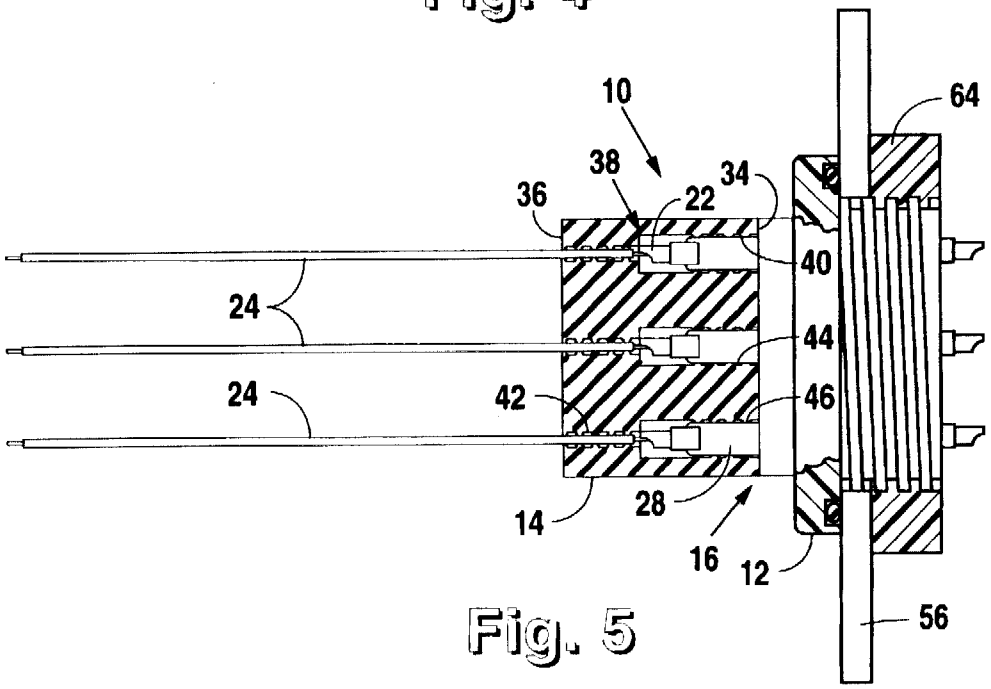
FIG. 5 is a cross-sectional of the electrical connector embodying the present invention wherein the body of the connector is the primary element of a pass-through assembly.

Importantly, each of the outwardly extending portions 20 of the conductors 18 are not only encapsulated within the body 12, but also are encapsulated, along a significant portion of the outwardly extending length, within a sheath 28 that is integrally formed with the body 12. Desirably, the outer surface of each of the conductors, or contacts, 18 have an outer surface that is defined along the encapsulated portion of the conductor 18, by a plurality of inwardly extending annular grooves 30 that aid in the retention of the conductor 18 within the body 12 and assure sealing of the conductor 18 with the body 12 and integral sheath 28. The opposite ends 32 of the conductors 18 are typically shaped to provide a pin contact member, as illustrated in FIGS. 3 or 4, or a pin-receiving socket, not shown, or adapted for connection to a lead as shown in the pass-through arrangement of the present invention as illustrated in FIG. 5.

Each of the conductor-surrounding sheaths 28 have a substantially smooth outer surface that extends along and around the outwardly extending portion 20 of each of the conductors 18 from the cable entry end 16 of the body 12 to a position adjacent, but not covering, the adapted distal end 22 of the conductor. In an illustrative example, each of the sheaths 18 have a length of about 0.400 in (1.02 cm) and an outer diameter of about 0.200 in (0.51 cm).

Figure 2:
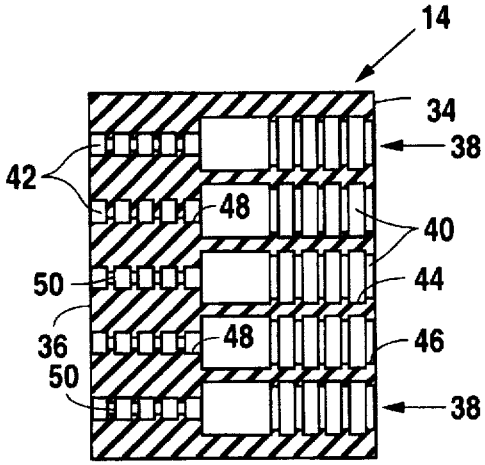
FIG. 2 is a cross-sectional view of the seal member embodying the present invention.
Figure 7:
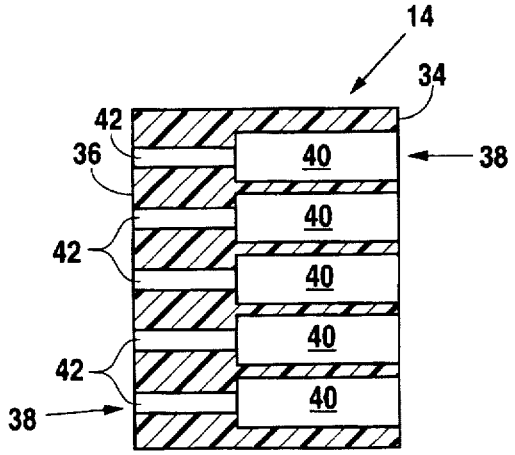
FIG. 7 is a cross-sectional view of another construction of the seal member embodying the present invention; and, FIG. 8 is a cross-sectional view of an alternate embodiment of the seal member and the body of an electrical connector embodying the present invention.

The seal member 14 has a first end 34 that is shaped to mate with, but not necessarily seal against, the cable entry end 16 of the body 12, and a second end 36 that is spaced from the first end 34. The seal member 14 has at least one, and again typically a plurality of, internal passageways 38 that extend through the seal member 14 from the first end 34 to the second end 36. As best shown in FIGS. 2 and 7, each of the internal passageways 38 have a first portion 40 that extends inwardly from the first end 34 a distance substantially equal to the length of the outwardly extending portion 20 of the conductor 18. The first portion 40 of each of the internal passageways 38 has an internal diameter along at least a portion of its length that is less than the predefined internal diameter of the sheath 28.

In the preferred embodiment of the present invention, the body 12, and accordingly the integrally formed sheaths 28, of the connector 10 is formed of a relatively rigid, electrically nonconductive, thermoplastic material such as injection moldable glass-filled polyurethane. In this embodiment, the seal member 14 is formed of an electrically nonconductive, resiliently compressible thermoplastic material having a hardness less than that of the body 12 and sheath 28, such as a blend of polyethylene and neoprene rubber, having a hardness of about 40 to 70 durometer (Shore A). When the seal member 14 is formed of a compressible material having a hardness less than that of the sheath 28, it is desirable to provide a plurality of annular seals, arranged in serial order, along the mutually mating surfaces of the internal passageway 38 and the sheath 28. For this purpose, the first portion 40 of each of the internal passageways 38 is defined by an internal wall comprising a plurality of annular alternating grooves 44 and compressibly deformable ridges 46 as best shown in FIG. 2. The deformable ridges 46 desirably have a free, or nondeformed, internal diameter that is less than the predetermined outer diameter of the sheaths 28. In the illustrative example, in which the sheaths 28 have an outer diameter of about 0.200 in (0.51 cm), the ridges 46 have an internal diameter of about 0.150 in (0.38 cm), and the alternating grooves 44 have an internal diameter of about 0.205 in (0.52 cm). Thus, it can be seen that the ridges 46 form a plurality of sealing rings around each of the sheaths 28 preventing the passage of water from the first end 34 of the seal member 14 to the distal end 22 of the conductor 18 at which the conductor is connected with a wire lead 24.

Figure 8:
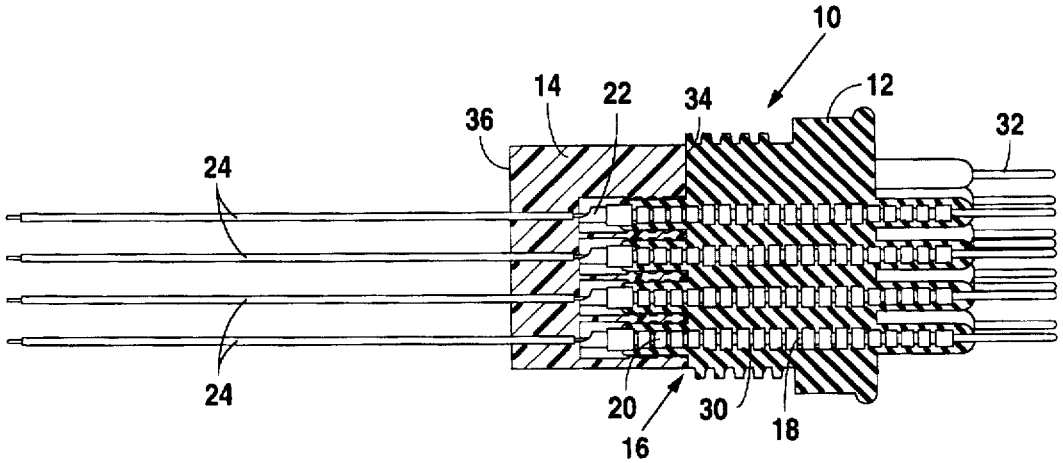

In another embodiment of the present invention, illustrated in FIG. 8, the body 12 of the connector 10, and accordingly also the sheaths 28 surrounding the outwardly extending portion 20 of each of the conductors 18, is formed of a compressible electrically nonconductive material having a hardness less than that of a relatively rigid seal member. In this arrangement, the first portion 40 of each of the internal passageways 38 in the seal member 14 is preferably defined by a smooth bore as shown in FIG. 7. The smooth bore has an internal diameter somewhat less than the outer diameter of the sheath 28, whereby the first portion 40 of the passageway 38, as in the earlier embodiment, forms an interference fit around the sheath and provides a seal preventing the passage of water from the first end 34 of the seal 14 to the distal lead-attachment end 22 of the conductor.

Each of the internal passageways 38 also have a second portion 42 that extends inwardly from the second end 36 of the seal member 14. The second portion 42 of each of the internal passageways 38 are adapted to provide an interference fit around the insulation jacket of each of the wire leads 24 that are inserted through the second portion 42 of the passageway 38 for electrical connection with the conductor 18 at the adapted distal end 22 of the conductor. When the seal member 14 is formed of a compressible material as described above with respect to the preferred embodiment of the present invention, the second portion 42 of the passageway is defined by an internal wall comprising a plurality of annular alternating grooves 48 and compressibly deformable ridges 50 as best shown in FIG. 2.

In a manner similar to the above-described first portion 40, the deformable ridges 50 in the second portion 42 of the internal passageway 38 have a free, or nondeformed, internal diameter that is less than the predetermined outer diameter of insulation jacket surrounding each of the electrical leads 24. For example, the insulation jacket surrounding a No. 24AWG wire typically has an outer diameter of about 0.050 in (1.27 mm). In this example, the inner diameter of the deformable ridges 50 in the second portion 42 of the internal passageway 38 would preferably have an internal diameter of about 0.03 in (0.76 mm). Thus, it can be seen that the ridges 50 advantageously form a plurality of sealing rings around each of the electrical leads 24 of a cable assembly 26 preventing the passage of water from the second end 36 of the seal member 14 to the distal end 22 of the conductor 18 at which the lead 24 is attached. Furthermore, it can be seen that even if the outer protective covering of the cable assembly 26 is breached by a tear, cut or other damage, even though water may be able to wick along the outer jacket of each of the leads 24 in the assembly 26, it will not be able to penetrate the seal member 14 to the connection point of each of the leads 26 with a respective conductor 18.

In the alternate embodiment wherein the body 12 and integrally formed sheaths 28 are formed of a compressible material having a hardness less than that of the seal member 14, the second portion 42 of the internal passageways 38 may be defined by smooth bore surfaces, as illustrated in FIG. 7, wherein the internal diameter of the bore is slightly less than that of the insulation jacket of the wire leads 24. Insulation jackets for electrical conductors are typically formed of a flexible and somewhat compressible material such a polyurethane and therefore can be drawn, with some resistance, through a slightly smaller diameter passageway and thereby form a watertight seal between the jacket and the wall of the passageway.

Alternatively, even though the preferred embodiment of the present invention includes a body 12 formed of a relatively rigid material and a seal member 14 having compressible sealing rings in the internal passageways 38, the body 12 and the seal member 14 of the electrical connector 10 may both be formed of relatively compressible materials. When both members are formed of relatively compressible materials, the internal passageway 38 extending through the body 12 and seal member 14 may have either a smooth bore or annular compressible deformable ridges 46 provided in the first portion 40, or a smooth bore or annular compressible deformable ridges 50 formed in the second portion 42, or a combination of respective smooth bores and ridges. In whichever arrangement, it is desirable that the internal surface of the internal passageway 38 provide an interference fit with respect to the adjacent sheath 28 surrounding the conductors 18 and the jacket of a respective wire lead 24.

Figure 6:
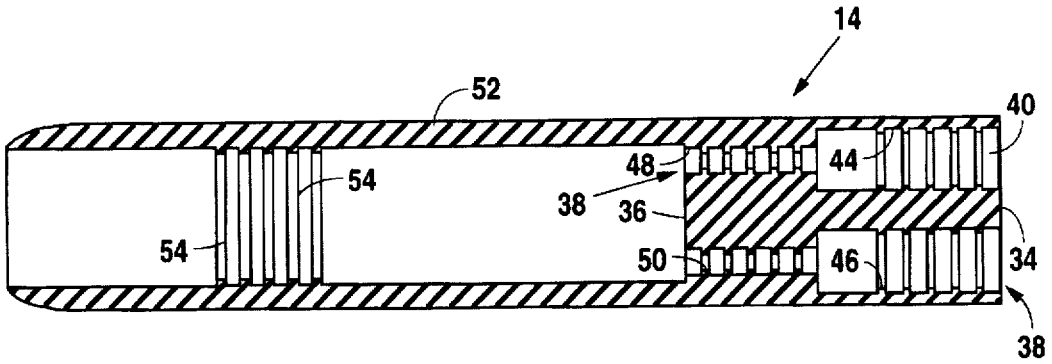
FIG. 6 is a cross-sectional of the seal member embodying the present invention in which the seal member includes a skirt adapted to extend over the entering cable assembly.

In another embodiment of the present invention, the seal member 14 has a protective annular wall or skirt 52 that extends outwardly from the second end 36 of the seal member 14 as shown in FIG. 6. In this arrangement, the skirt 52 provides added support for the cable assembly 26 at a position near its end, or termination. The internal wall of the protective skirt 52 desirably has a plurality of inwardly extending ridges 54 which have an internal diameter less than the outer diameter of the cable assembly 26. The ridges 54 provide an additional seal around the outer jacket of the cable assembly 26.

In conventional practice, the electrical connector 10 typically has a plurality of electrical conductors 18 arranged in a predetermined pattern and, accordingly, the seal member 14 includes a like plurality of passageways 38 arranged in the same predetermined pattern. As an alignment aid, the body 12 may have an index pin and the seal member 14 provided with a suitable mating receiving port for the pin. Alternatively, the body 12 and seal member 14 may include suitable key and mating keyway elements to aid alignment of the seal member 14 with the body 12 with the prearranged pattern of sheath-enclosed conductors 18 extending outwardly from the cable entry end 16 of the body 12.

In another embodiment of the present invention, the seal member 14 may be constructed of a compressible material and protectively covered within a protective case formed of a harder, relatively rigid material on its external circumferential surface. This bi-material constructional arrangement is described in association with the inter-connector coupling member defined in copending U.S. patent application Ser. No. 08/389,253, filed Feb. 16, 1995 by the inventor of the present invention and titled FIELD REPAIRABLE ELECTRICAL CONNECTOR.

The body 12 of the electrical connector 10 embodying the present invention may have a construction adapted for interconnection with a mating connector, as illustrated in FIGS. 3 and 4, or be adapted as shown in FIG. 5 to provide a thru, or pass-through, assembly enabling electrical signals to be transmitted through the wall 56 of a panel or box enclosure without requiring a separable connector. In the mating connector arrangement, the body 12 advantageously has sheaths formed around the portion of the electrical conductor 18 that extends outwardly from the end of the body 12 spaced away from the cable entry end 16, and desirably includes a coupling member 62 between connectors as described in copending U.S. patent application Ser. No. 08/226,009, filed Apr. 11, 1994 by the inventor of the present invention and titled FIELD REPAIRABLE ELECTRICAL CONNECTOR.

In the thru connector arrangement, the body 12 of the connector is mounted to the wall 56 by a retaining nut 64. The opposite ends of the conductors 18 are adapted for connection with a lead or other electrical component and are generally enclosed within a sealed box, operating panel or other enclosure partially defined by the wall 56. There is, therefore, no requirement in this application for sealing the electrical connection at the internally disposed ends of the conductor 18.

The connector 10 embodying the present invention is typically enclosed within a conventional separable shell assembly 60. The shell assembly 60 assures secure engagement of the seal member 14 with the body 12 and prevents inadvertent separation of the seal member 14 and body 12 after assembly and during subsequent use.

In a typical use application, the various components of the shell assembly 60 are first positioned over the cable assembly 26. Individual wire leads 24 are then individually separated from the cable assembly 26 and inserted one at a time into the second portion 42 of the seal member 14. The ends of the wire leads 24 are then pushed, or pulled through the passageway 38 until there is a length of the lead wire 24 exposed that is sufficient to provide appropriate attachment to the adapted end 22 of the conductor 18. An appropriate portion of the insulating jacket is then stripped from the end the wire lead 24, and the bare wire end attached by soldering, crimping, twisting or other suitable method, to the adapted end 22 of the conductor 18. The seal member 14 is then coupled with the body 12 by pushing the seal member 14 over the sheaths 28 simultaneously with pulling the excess length of the wire leads 24 from the second portion 42 of the passageway. The elements of the shell assembly 60, if used, are then brought over the assembled connector 10, and the electrical connector 10 embodying the present invention is ready for use.

In field repair applications, after removal of the separable shell assembly 60, the seal member 14 can be pulled away from the body 12, exposing the connection points of the wire leads 24 with the conductors 18. After completion of appropriate repairs, for example repair of the connection itself or substitution of a failed lead 24 with a previously unused lead 24 of the cable assembly 26, the seal member 14 and body 12 are reassembled as described above.

Thus, it can be seen that the electrical connector 10 embodying the present invention not only provides an economical and simple method of sealing the cable entry end of an electrical connector, but also enables the electrical connector to be repaired in the field with conventional tools and equipment.

INDUSTRIAL APPLICABILITY

The electrical connector 10 embodying the present invention is particularly useful in underwater applications, such as seismic exploration, and in other applications where it is desirable to protect the connection of a wire lead with the conductor, such as in certain highly corrosive, volatile, or potentially explosive atmospheres.

The electrical connector 10 embodying the present invention is economical to produce and provides easy access to the important connection juncture of a wire lead with a conductor. Furthermore, the electrical connector 10 embodying the present invention provides an advantageous water seal around each wire lead of a cable assembly, and around each connection of each lead with a respective connector conductor. This arrangement, in cooperation with embedment of the connector conductors within an integrally formed body and sheath, effectively seals the cable entry end of the connector.

Although the present invention is described in terms of certain embodiments and illustrative examples, those skilled in the art will recognize that changes in the illustrative embodiments and examples may be made without departing form the spirit of the invention. Such changes are intended to fall within the scope of the invention. Other aspects, features and advantages of the present invention can be obtained by a study of the drawings and this disclosure.

What I claim is:

1. An electrical connector assembly, comprising:

a body having a cable entry end, at least one electrical conductor disposed within the body and having a portion extending outwardly from the cable entry end of the body with a distal end of said outwardly extending portion of the electrical conductor being adapted for connection with an electrical lead component of a predefined cable assembly, and at least one sheath integrally formed with the body and having a predefined outer diameter extending a predetermined distance along and around said outwardly extending portion of the conductor from the cable entry end of the body to a position proximate said distal end of the conductor, said outwardly extending portion of the electrical conductor having a predefined length that is encapsulated along a significant portion of said predefined length by said sheath; and a seal member having a first end adapted for mating with the cable entry end of said body, a second end spaced from said first end, and at least one internal passageway extending through the seal member from said first end to said second end, said internal passageway having a first portion extending inwardly from said first end a distance substantially equal to the length of the outwardly extending portion of the conductor and having an internal diameter along at least a portion of said length that is less than the predefined outer diameter of said sheath surrounding said conductor whereby an interference fit is provided between said sheath and said passageway, and a second portion extending inwardly from said second end and adapted to provide an interference fit around the insulation jacket of a predefined electrical lead when inserted therethrough for attachment to said distal end of the conductor.

2. An electrical connector assembly, as set forth in claim 1, wherein said sheath extending around said outwardly extending portion of the conductor is formed of a substantially rigid material having a predetermined hardness, and said seal member is formed of a compressible material having a hardness less than the predetermined hardness of the sheath.

3. An electrical connector assembly, as set forth in claim 2, wherein the first portion of said passageway extending through the seal member is defined by an internal wall comprising a plurality of annular alternating grooves and ridges wherein the ridges form a plurality of compressibly deformable sealing rings having a nondeformed internal diameter less than the predetermined outer diameter of said sheath of the body, and the second portion of the passageway extending through the seal member is defined by an internal wall comprising a plurality of annular alternating grooves and ridges wherein the ridges form a plurality of compressibly deformable sealing rings adapted to have a nondeformed internal diameter less than the outer diameter of a predefined electrical lead passing therethrough.

4. An electrical connector assembly, as set forth in claim 1, wherein said seal member is formed of a substantially rigid material having a predetermined hardness and said sheath extending around the outwardly extending portion of the conductor is formed of a compressible material having a hardness less than the predetermined hardness of the sheath.

5. An electrical connector, as set forth in claim 1, wherein said body includes a plurality of electrical conductors arranged in a predetermined pattern each of which have a portion extending outwardly from the body and surrounded along a portion of their respective length by a sheath, and said seal member includes a like plurality of passageways extending through the seal member and arranged in said predetermined pattern.

6. An electrical connector, as set forth in claim 1, wherein said seal member has an annular wall extending outwardly from said second end, said annular wall having a plurality of radially compressible inwardly extending ridges formed on an internal surface of the wall, said ridges having a non-compressed inner diameter less than the outer diameter of said predefined cable assembly.

7. An electrical connector, as set forth in claim 1, wherein said seal member is formed a compressible material enclosed within a protective case formed of a relatively rigid material disposed on the external circumferential surface of said seal member.

8. A removable seal for sealing the termination of a cable assembly, said seal being formed of a substantially rigid material and comprises a first face surface adapted to mate with a cable entry end of a predefined electrical connector, a second face surface spaced from said first face surface, and at least one internal passageway extending through the seal from said first face surface to said second face surface, said internal passageway having a first portion extending inwardly from said first face surface a distance substantially equal to the predefined length of a sheath extending outwardly from the cable entry end of the connector in surrounding encapsulating relationship with a predefined portion of an electrical conductor extending through the connector, said first portion having an internal diameter adapted to deform a compressible outer surface of said sheath surrounding the conductor when assembled therewith, and a second portion extending inwardly from said second face surface has an internal diameter adapted to deform an outer surface of an insulation jacket of the wire lead when inserted therethrough.

9. A removable seal for sealing the termination of a cable assembly, as set forth in claim 8, wherein said seal is formed of a compressible material and the first portion of said internal passageway is defined by an internal wail comprising a plurality of annular alternating grooves and ridges wherein the ridges form a plurality of compressibly deformable sealing rings having an internal diameter adapted to sealingly engage the sheath of the conductor when assembled therewith, and second portion of said internal passageway is defined by an internal wall comprising a plurality of annular alternating grooves and ridges wherein the ridges form a plurality of compressibly deformable sealing rings having an internal diameter adapted to sealingly engage the outer surface of a wire lead passing therethrough.

10. A removable seal for sealing the termination of a cable assembly, as set forth in claim 8, wherein said seal includes an annular wail extending outwardly from said second face surface, said annular wall having a plurality of radially compressible inwardly extending ridges formed on an internal surface of the wail, said ridges having a noncompressed inner diameter less than the outer diameter of said predefined cable assembly.

11. A removeable seal for sealing the termination of a cable assembly, as set forth in claim 8, wherein said seal is formed a compressible material enclosed within a protective case formed of a relatively rigid material disposed on the external circumferential surface of said seal.

* * * * *